United States Patent [19]

Kyp

[11] 3,997,809

[45] Dec. 14, 1976

[54] DECORATIVE LAMP HAVING AN INTEGRAL BASE AND ENVELOPE

[76] Inventor: Robert J. Kyp, 526 Geneva Road, Glen Ellyn, Ill. 60137

[22] Filed: May 16, 1975

[21] Appl. No.: 578,038

[52] U.S. Cl. ..... 313/160; 240/10 R; 313/220; 313/315; 313/318; 339/102 L; 339/119 L

[51] Int. Cl.[2] ..... H01K 1/22; H01K 1/28; H01K 1/44; H01R 13/60

[58] Field of Search ..... 313/153, 160, 318, 315, 313/220; 339/102 R, 102 L, 119 L, 12 L, 144 R, 144 T; D26/1 G; D48/20 R, 20 B, 20 C, 20 J; 240/10 R; 315/267

[56] References Cited

UNITED STATES PATENTS

| | | | |
|---|---|---|---|
| 303,202 | 8/1884 | Ball | 313/271 |
| 452,780 | 5/1891 | Flagg | 339/102 L |
| 467,270 | 1/1892 | Wilkins | 313/315 X |
| 507,558 | 10/1893 | Nickerson | 313/271 X |
| 695,844 | 3/1902 | Thayer | 339/144 R X |
| 1,712,996 | 5/1929 | Hoffman | 313/315 X |
| 2,884,555 | 4/1959 | Peterson | 339/144 R X |
| 3,237,053 | 2/1966 | Kyp | 313/160 X |
| 3,445,720 | 5/1969 | Horan | 313/318 X |
| 3,531,636 | 9/1970 | Birch | D48/20 E |

*Primary Examiner*—Palmer C. Demeo

[57] ABSTRACT

A lamp includes a sealed envelope with an integrally formed base so as to form a single unit. An illuminating filament is enclosed within the sealed envelope and leads connected to the filament pass through a stem contained within the envelope. An electrical cord is passed through the base and attached to the leads. An embodiment of the lamp further includes a loop filament, and a magnet positioned in proximity to the envelope.

14 Claims, 6 Drawing Figures

Fig. 1
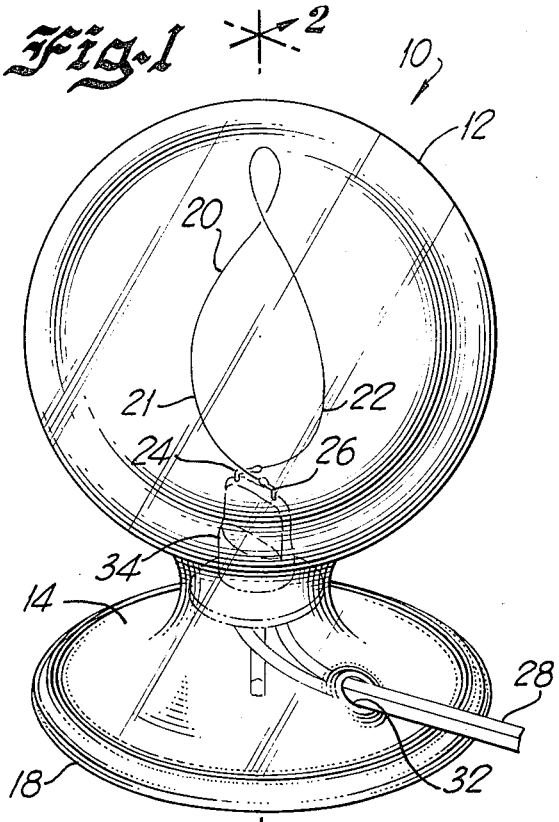
Fig. 2
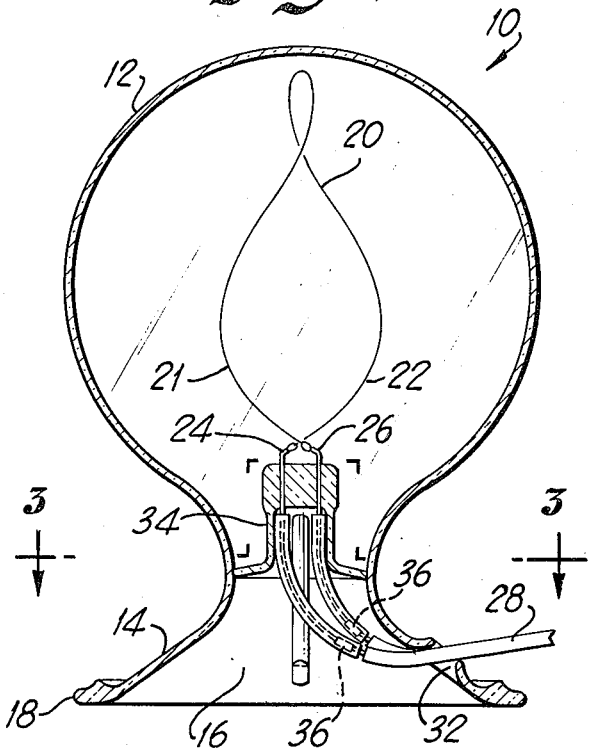
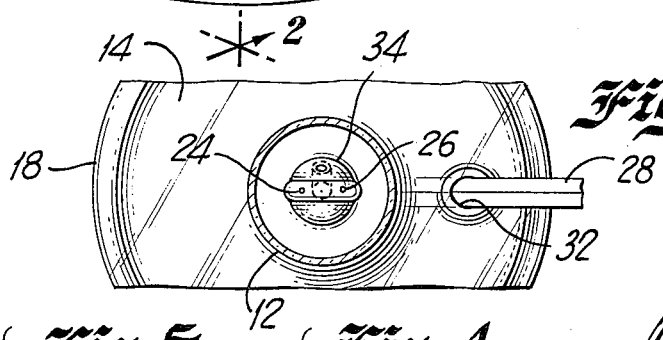
Fig. 3
Fig. 5
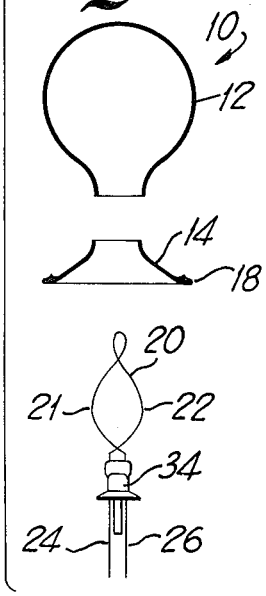
Fig. 4
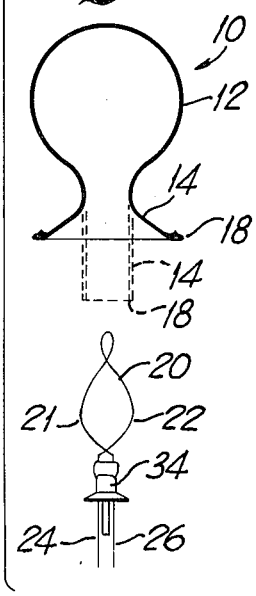
Fig. 6
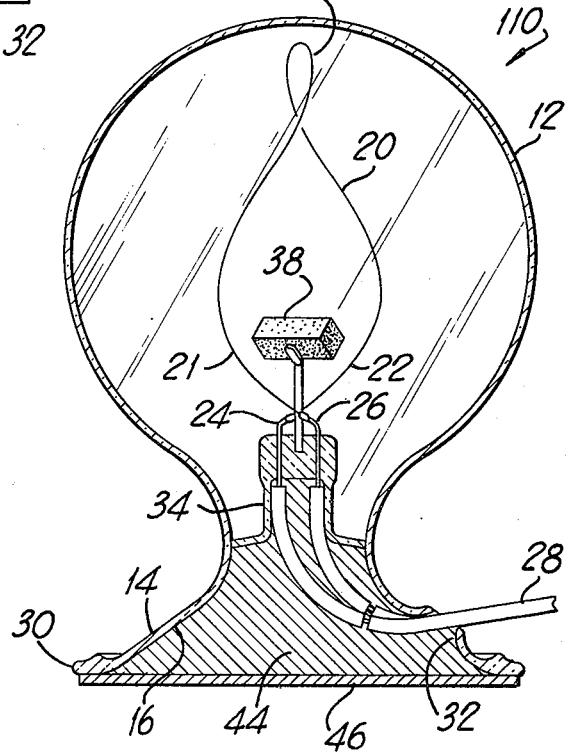

DECORATIVE LAMP HAVING AN INTEGRAL BASE AND ENVELOPE

BACKGROUND OF THE INVENTION

1. Field of the Invention

The present invention generally relates to a new and improved lamp providing economical and decorative means of illumination, and, more particularly, to a new and improved single unit lamp usable to provide illumination and which is disposable after the lamp filament is no longer operable.

2. Description of the Prior Art

Lamps used for illumination or decoration comprise a cord, one end of which is plugged into a household outlet and connected at the other end to the base of the lamp. Mounted upon this base is an electrical socket into which an electric light bulb can be removably secured. Such lamps are of a permanent nature, and once the filament of the electric light bulb burns out the bulb can be removed and a new bulb replaced in the same lamp. Because these prior art lamps consist of several different components which are permanent in nature, the lamp is usually costly. This cost necessitates that the lamp be used for long periods of time and only the blub, because of its lower cost, is periodically discarded. Consequently, although the lamp owner's taste and requirements may change, the permanency of the prior art lamp is such that it is not disposable without incurring substantial cost.

SUMMARY OF THE INVENTION

An object of the present invention is to provide a new and improved decorative device for providing illumination.

Another object of the present invention is to provide a new and improved decorative lamp including a sealed envelope with an integrally formed base such that the device is a single unit which can be readily disposed of after use.

Briefly, the present invention is directed to a new and improved device, commonly referred to as a lamp, for providing illumination and decoration. The lamp includes a sealed envelope, an integrally formed base, and a filament located within the envelope. The ends of the filament are connected to an electrical cord which may be plugged into a wall outlet providing electric current and thereby illuminating the filament and the lamp.

BRIEF DESCRIPTION OF THE DRAWINGS

The above and other objects and advantages and novel features of the present invention will appear from the following detailed description of the embodiments of the invention illustrated in the accompanying drawings wherein:

FIG. 1 is a vertical elevational view of a lamp constructed in accordance with the principles of the present invention;

FIG. 2 is a cross-sectional view of the lamp of the present invention taken along line 2—2 of FIG. 1;

FIG. 3 is a partial cross-sectional view of the lamp of the present invention taken along line 3—3 of FIG. 2;

FIG. 4 is a schematic illustration of one procedure of assembling the lamp of the present invention;

FIG. 5 is a schematic illustration of an alternative procedure of assembling the lamp of the present invention; and FIG. 6 is an elevational, cross-sectional view of an alternative embodiment of the lamp of the present invention.

DESCRIPTION OF THE PREFERRED EMBODIMENT

With reference to FIG. 1 of the drawings, there is illustrated a new and improved lamp 10 constructed in accordance with the principles of the present invention. The lamp 10 may be plugged into any source of electrical current, typically a househould outlet, and thereafter the lamp provides a decorative source of illumination. The lamp 10 includes an envelope 12 having a base 14 integrally formed thereon. For example, the envelope 12 and base 14 are permanently joined or formed as one unit and the lamp 10 stands on the base 14 without additional means of support.

In accordance with an important feature of the present invention, the envelope 12 and the base 14 are formed as a single unit or article of manufacture. In the embodiments of the invention illustrated in FIGS. 1–4 and 6, the envelope 12 and base 14 are fabricated from one piece of material and the base 14 is flared to form a peripheral edge 18 upon which the lamp may stand. The base 14 and edge 18 define a cavity 16. The process of forming the lamp 10 out of one piece of material allows economical production and resultant lower cost to the purchaser.

The lamp 10 includes a filament 20 of any desired shape and illustrated as having a generally loop-shaped configuration. The ends 21 and 22 of the filament 20 are connected to leads 24 and 26 which in turn are connected to electrical cord 28. A conventional household plug (not shown) is connected to the end of cord 28, and, if desired, a conventional in-line on-off switch may be connected along cord 28.

In constructing a specific embodiment of the lamp 10, a glass envelope 12 is molded with a perpendicularly extending tube (FIG. 4) which is flared to form a base 14 in the desired configuration, preferably such that the transverse dimension of base 14 is approximately equal to or greater than to the same dimension of the envelope 12 to provide stability. An opening 32 is formed in the base 14 by drilling or otherwise to allow the insertion of the electrical cord 28 into the cavity 16.

Press 34 containing leads 24 and 26 is positioned within envelope 12. The upper portions of the leads 24 and 26 extend above press 34 and are connected to the ends 21 and 22 of loop filament 20. In addition, the lower ends of leads 24 and 26 extend below the press 34 and are connected to the electrical cord 28, as by eyelets 36 made of a conductive metal and are covered by plastic or the like.

The press 34 is positioned in the envelope 12 such that the filament 20 is located within envelope 12 and press 34 is permanently secured to the sides of the envelope 12. The air in the envelope is then withdrawn and the envelope 12 is sealed.

It is not intended to limit the construction of envelope 12 and base 14 to a single piece of material. Lamp 10 could be constructed by permanently attaching a separate base 14 to envelope 12 (FIG. 5) in a manner well known in the art.

A lamp generally designated as 110 and comprising a further embodiment of this invention is shown in FIG. 6. In this embodiment, parts identical to those of the previous embodiment are given identical numbers.

Lamp 110, envelope 12 and base 14 are constructed in a manner similar to that previously discussed. In addition, loop filament 20 is positioned within the envelope 12 and a magnet 38 is positioned in proximity to the filament 20. The filament 20 is preferably made of carbon and converges to a curved upper end 40. The lower ends 21 and 22 of filament 20 are connected to the upper portions of leads 24 and 26 which extend above the press 34. Also mounted in and extending above the press 34 is support pin 42. Magnet 38 is mounted on top of support pin 42 and may be attached by spot welding, or magnet 38 may have an aperture into which support pin 42 is inserted. The ends of leads 24 and 26 are connected to electrical cord 28 in a manner previously described.

While the magnet 38 as shown in FIG. 3 is positioned within the envelope 12, it may be located either within or outside of envelope 12; the only requirement being that magnet 38 is in sufficient proximity to the filament 20 such that the magnetic field of magnet 38 influences the magnetic field produced by the AC current flowing through filament 20.

A description of the operation of lamp 10, shown in FIG. 3, is set forth in R. J. Kyp, U.S. Pat. Re. No. 27,443. Briefly, when electrical cord 28 is connected to a source of AC current, energization of the filament 20 establishes a magnetic field of alternating polarity. Magnet 38 influences the filament 20 as the magnetic field created by the current passing through filament 20 reverses polarity. This results in an oscillation of loop 20 creating a flame effect within the field of movement of filament 20.

It may be desirable to increase the stability of lamps constructed in accordance with the invention. As illustrated in FIG. 6, this may be accomplished by filling the cavity 16 formed by base 14 with a mass 44 of substantially greater weight than the weight of the lamp 10. This mass 44 may be of a material such as plaster or the like and serves as an additional weight in the base portion of lamp 10 to prevent tipping of the lamp 10 from an upright position. Additionally, a cover 46 may be attached to the peripheral edge 30 of base 14 and to the mass 44. This cover 46 may be of a material such as felt to provide a smooth surface to prevent damage to the table or other object upon which lamp 10 is placed, and may be used whether the mass 44 is positioned within cavity 16 or not.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. A lamp comprising
a sealed envelope,
a base extending from said envelope and integrally formed therewith such that said base and envelope comprise a single unit,
an illuminating filament contained within said envelope,
a stem positioned within said envelope and carrying said filament,
a pair of leads embedded in said stem the upper ends of which are connected to said filament, and
an electrical cord attached to said leads,
wherein the perimeter of said base is on a plane transverse to the longitudinal axis of said envelope, the transverse dimension of said base being at least substantially equal to the corresponding dimension of said envelope such that said perimeter supports said lamp in an upright position.

2. A lamp as defined in claim 1 wherein said base is unitary with said envelope.

3. A lamp as defined in claim 1 wherein the periphery of said base forms a cavity.

4. A lamp as defined in claim 1 wherein the periphery of said base forms a cavity within which a material of mass substantially greater than the mass of said lamp is positioned.

5. A lamp as defined in claim 1 further comprising a cover attached to said base.

6. A lamp as defined in claim 1 wherein said filament is of a pointed loop configuration.

7. The lamp described in claim 1 wherein said base is of the same material as said envelope.

8. A lamp comprising
a sealed envelope,
a base integrally formed with said envelope such that said base and envelope comprise a single unit,
a magnet in proximity to said envelope,
an illuminating filament contained within said envelope,
a stem positioned within said envelope and carrying said filament,
a pair of leads embedded in said stem the upper ends of which are connected to said filament, and
an electrical cord attached to said leads,
wherein the perimeter of said base is in a plane transverse to the longitudinal axis of said envelope, the transverse dimension of said base being at least substantially equal to the corresponding dimension of said envelope such that said perimeter supports said lamp in an upright position.

9. A lamp as defined in claim 8 wherein the magnet is supported within the envelope by said stem.

10. A lamp as defined in claim 8 wherein the periphery of said base forms a cavity.

11. A lamp as defined in claim 8 wherein the periphery of said base forms a cavity within which a material of mass substantially greater than the mass of said lamp is positioned.

12. A lamp as defined in claim 8 further comprising a cover attached to said base.

13. A lamp as defined in claim 8 wherein said filament is of a pointed loop configuration.

14. The lamp described in claim 8 wherein said base is of the same material as said envelope.

* * * * *